US007392746B2

(12) United States Patent
Hansen

(10) Patent No.: US 7,392,746 B2
(45) Date of Patent: Jul. 1, 2008

(54) BULLET COMPOSITION

(76) Inventor: Richard D. Hansen, 321 E. Charlotte Ter., Mustang, OK (US) 73064

( * ) Notice: Subject to any disclaimer, the term of this patent is extended or adjusted under 35 U.S.C. 154(b) by 1 day.

(21) Appl. No.: 11/427,537

(22) Filed: Jun. 29, 2006

(65) Prior Publication Data

US 2008/0000379 A1 Jan. 3, 2008

(51) Int. Cl.
*F42B 12/74* (2006.01)

(52) U.S. Cl. ..... 102/517; 102/506

(58) Field of Classification Search ..... 102/517, 102/506, 501, 516, 439; 86/54, 57
See application file for complete search history.

(56) References Cited

U.S. PATENT DOCUMENTS

| | | | | |
|---|---|---|---|---|
| 3,785,293 | A | 1/1974 | Barr et al. | |
| 3,902,683 | A | 9/1975 | Bilsbury | |
| 3,911,824 | A | 10/1975 | Barr et al. | |
| 3,948,263 | A | 4/1976 | Drake, Jr. et al. | |
| 3,951,035 | A | 4/1976 | Dautzenberg et al. | |
| 3,982,536 | A | 9/1976 | Krogseng et al. | |
| 4,326,524 | A | 4/1982 | Drake, Jr. et al. | |
| 4,449,982 | A | 5/1984 | Gould, III | |
| 4,603,637 | A | 8/1986 | Snide et al. | |
| 4,664,664 | A | 5/1987 | Drake, Jr. | |
| 4,811,666 | A | 3/1989 | Lutfy | |
| 4,942,818 | A | 7/1990 | Saxby | |
| 4,949,644 | A | 8/1990 | Brown | |
| 4,949,645 | A | 8/1990 | Hayward et al. | |
| 5,078,054 | A | 1/1992 | Ashok et al. | |
| 5,214,237 | A | 5/1993 | McArthur | |
| 5,237,930 | A | 8/1993 | Belanger et al. | |
| 5,279,787 | A | 1/1994 | Oltrogge | |
| 5,399,187 | A | 3/1995 | Mravic et al. | |
| 5,535,678 | A | 7/1996 | Brown | |
| 5,616,642 | A | 4/1997 | West et al. | |
| 5,665,808 | A | 9/1997 | Bilsbury et al. | |
| 5,679,920 | A | 10/1997 | Hallis et al. | |
| 5,760,331 | A | 6/1998 | Lowden et al. | |
| 5,767,438 | A | 6/1998 | Lang et al. | |
| 5,786,416 | A * | 7/1998 | Gardner et al. | 524/440 |
| 5,814,759 | A | 9/1998 | Mravic et al. | |
| 5,852,255 | A | 12/1998 | Hallis et al. | |
| 5,852,858 | A | 12/1998 | Hallis et al. | |
| 5,877,437 | A | 3/1999 | Oltrogge | |
| 5,880,398 | A | 3/1999 | Crilly et al. | |
| 5,894,645 | A | 4/1999 | Hallis et al. | |
| 6,074,454 | A | 6/2000 | Abrams et al. | |
| 6,090,178 | A | 7/2000 | Benini | |
| 6,101,949 | A | 8/2000 | Maucourt et al. | |
| 6,257,149 | B1 | 7/2001 | Cesaroni | |
| 6,375,971 | B1 | 4/2002 | Hansen | |
| 6,536,352 | B1 | 3/2003 | Nadkarni et al. | |
| 6,916,354 | B2 * | 7/2005 | Elliott | 75/228 |
| 2002/0005137 | A1 | 1/2002 | Stone | |
| 2002/0124759 | A1 | 9/2002 | Amick | |
| 2004/0159262 | A1 | 8/2004 | LeaSure | |
| 2005/0008522 | A1 | 1/2005 | Amick | |
| 2005/0016411 | A1 | 1/2005 | Amick | |
| 2006/0027129 | A1 | 2/2006 | Kolb | |

FOREIGN PATENT DOCUMENTS

| | | | |
|---|---|---|---|
| EP | 96617 | A1 * | 12/1983 |
| EP | 641836 | A2 * | 3/1995 |
| EP | 775724 | A1 * | 5/1997 |

OTHER PUBLICATIONS

Christie, R. James et al. "Deliver at a Distance: Ballistics for Wild Bison Live Brucella Vaccination" Consumer and Diversified Section, C&DP, pp. 7 and 21 (2 pages), Mar. 1, 2005.

* cited by examiner

*Primary Examiner*—James S Bergin
(74) *Attorney, Agent, or Firm*—McKee, Voorhees & Sease, P.L.C.

(57) ABSTRACT

A lead free environmentally friendly ammunition which may be tailored within a range of compositions for specific uses, but generally comprises a mixture of metal powder and mineral filler in combination with a water soluble binder plastic resin and a lubricant. For hunting uses and other uses requiring high level accuracy the amount of metal powder is increased, for other uses where precision shooting is less important such as drug dosing of animals, less metal is used along with increased amounts of mineral filler. The bullets are accurate, and can be frangible. Formulations within the overall range may also be used to make shot for shotgun shells.

15 Claims, No Drawings

BULLET COMPOSITION

FIELD OF THE INVENTION

The field of this invention relates to particulate composites for use in making ballistic projectiles, that is to say bullets for use in handguns and rifles and pellets for use in shotguns. Each particulate aliquot has a composition with substantially the same proportions of material, all tailored to the specific end use in question. But all formulations have environmental friendliness in common.

BACKGROUND OF THE INVENTION

For as long as firearms have been known, bullets and shot have been fabricated from lead. Lead has been the most commonly accepted metal of choice because of its unique collection of properties making it ideally suited for use with firearms. It is, for example relatively low in cost, soft, melts at a low temperature, is dense and causes little damage to gun barrels, all while providing consistent accuracy. One may well wonder why anyone would seek to replace lead with other materials. The answer is that lead has been discovered to be poisonous and of environmental concern. For example lead contamination of marshes offers significant potential for waterfowl lead poisoning when birds ingest lead from spent shells. As a result, lead has been banned for shooting migratory waterfowl in the United States. Lead also can cause lead contamination in many other environments, creating potential hazards both for the ecosystem and for the food chain. As a result of these known disadvantages with lead, many inventors have experimented with environmentally friendly or so-called "green bullets" that contain little or no lead. One of the many motivations for this effort is that lead contamination resulted in closure of hundreds of indoor and outdoor target ranges. For example it has been reported that 1,100 indoor ranges have been closed because they lacked adequate ventilation to disperse airborne lead emitted when lead core bullets are fired. Such range closings have affected both national guard and reserve units by cutting down on training time and forcing them to travel long distances to other more suitable ranges.

It has also been reported that the United States armed forces use between 300 million and 400 million rounds of small caliber ammunition each year. Of course most of this ammunition is used in target practice. This dramatically increases the amount of hazardous lead deposits in shooting ranges. For example it has been reported in the national press that the Pentagon estimated the cost of lead cleanup of contaminated sites at closed military bases as high as nine billion dollars!

It can be seen therefore that there is a substantial need for the development of new compositions of matter that are satisfactory for bullets and shot which are environmentally friendly and yet provide suitable accuracy, equivalent to lead base composites.

At first blush it may seem inconsistent to develop green bullets when the object of bullets is of course precision striking and lethal shooting. However the fact is that most bullets are used for training and target shooting, so the purpose of green or environmentally friendly bullets is not at all inconsistent. There are also significant uses for bullets other than lethal shooting, for example dosing large animals with medicaments etc. For the latter uses, bullets must contain little or no toxic materials, have accuracy for short and sometimes long distances, and be relatively inert to their payload (medicament) which they carry and to the animal that is being injected with the payload.

Accordingly it is a primary object of the present invention to provide a particulate composition which is environmentally friendly, which allows the making of bullets with accuracies which are generally equal to the accuracy of lead bullets, and which may be tailor made amongst a range of particulate composition formulations specifically for the ultimate end use of the projectile such as target shooting, law enforcement uses, military uses, animal medicating, etc.

Another object is to fulfill the substantial need as above discussed.

A still further objective is to provide a composition for bullets and shot which perform well in conventional firearms.

Another object of the invention relates to a method of preparing the particulate composition by adopting use of suitable and conventional methodology such as spray drying, pelleting, injection molding, compression molding, etc.

The method and means for accomplishing each of the above objectives as well as others will become apparent from the detailed description which follows.

It goes without saying, and it will be apparent to those of ordinary skill in the art, that modifications within the range of the formulations here presented may be achieved and still fall within the spirit and scope of the invention. Applicant therefore prepares the balance of this application with the understanding and reliance on the U.S. Patent Laws including the Doctrine of Equivalence in order to provide adequate protection for the invention herein disclosed.

SUMMARY OF THE INVENTION

A lead free environmentally friendly ammunition which may be tailored within a range of compositions for specific uses, but generally comprises a mixture of metal powder and mineral filler in combination with a water soluble plastic binding resin and a lubricant. For hunting uses and other uses requiring high level accuracy the amount of metal powder is increased. For other uses where precision shooting at longer distances is less important such as drug dosing of large animals, less or no metal is used employing increased amounts of mineral filler. The bullets are accurate, and can be frangible. Formulations within the overall range may also be used to make shot for shotgun shells. The formulations of this invention are also suitable for a wide range of so-called "green uses", that is to say environmentally friendly uses.

DETAILED DESCRIPTION OF A PREFERRED EMBODIMENT

In general this invention comprises tailor made bullets and shot which may be specifically designed for the end use in question, and which are also environmentally friendly. The term "bullet" as used herein is used in the broadest sense to mean firearms projectiles and includes rifle and pistol bullets and shot for shotgun shells. The invention relies upon, as a major component, a combination of metal powder and environmentally friendly mineral filler, with the relative amounts of each changed depending upon the end use. This major component blend is then mixed with a binder material which is preferably a water soluble plastic resin and along with a lubricant, preferably a fatty acid lubricant. These materials are all mixed together to provide homogeneity such that each portion thereof includes some of each, in the proportions measured out for the entire composite. The blend is then extruded or otherwise pelleted, injection molded, etc. by conventional means to prepare the final bullet or shot.

The first major component is from 0% up to 90% by weight of a combination of metal powder and mineral filler. Preferably the amount is from about 60% by weight to about 90% by weight. There must be some of at least one of the metal powder or mineral filler present. Both need not be present, but often are. Put another way, one but not both of the major component mixture can be 0%. For some uses there will be no metal powder, for others, it will be the most substantial component. Where metal powder is used, and generally it is used when accuracy at a longer distance is required, the metal used is an environmentally friendly metal substitute for lead. Such metals have been reported and are known in the art and can be, for example, copper, tungsten, steel, bismuth, ferrotungsten, tantalum, zinc, antimony, etc. with even various alloy mixtures or combinations of such. The preferred particle size of the metal powder, and as far as that goes, also for the mineral filler is generally within the range of particle sizes of about 100 U.S. mesh standard sieve screen to about 325 U.S. mesh standard sieve screen. A most preferred metal powder is tungsten.

The mineral fillers used may be any naturally occurring environmentally friendly inexpensive mineral filler. The most suitable is calcium carbonate, simply because of its known environmental friendliness and its naturally occurring abundance. For example calcium carbonate occurs in nature as aragonite, oyster shells, calcite, chalk, limestone, marble, marl, travertine etc. Other minerals can be used as well such as silicates, pulverized granite, lava, etc.

Generally speaking, the composition of the composite is tailored for the specific use by altering the ratios of metal powder to mineral filler. For example higher amounts of metal and lower of amounts of calcium carbonate are used for hunting bullet uses and uses for law enforcement or military bullets. Correspondingly, for things such as police training in close indoor environments, so called "cowboy action" and animal dosing of medicaments such as dosing wildlife and domestic livestock etc. lower amounts of metal and higher amounts of calcium carbonate filler can be used. Experimentation has shown that where no metal powder is used the accuracy falls off substantially at ranges beyond 50 feet. Generally speaking in preferred compositions for high level accuracy the amount of metal powder will be a major component in the mix with the balance being mineral filler. For medicament dosing the amount of metal powder can be minimal or nonexistent with the substantial portion if not all of this first major component being pulverized calcium carbonate powder of mineral filler, of course meeting the particle size requirements mentioned. For dosing bullets the preferred amount of mineral filler is about 40% to about 55% by weight.

The major component of metal/mineral filler requires a binder. The binder in this invention must be one which is environmentally friendly. In this instance it has been found that compatible binders can be derived from water soluble plastic resins. The preferred water soluble plastic resins are hydroxypropylcellulose and hydroxypropylmethylcellulose, but other resins that are both water soluble and biodegradable may be used. Such examples are methylcellulose, carboxymethylcellulose, hydroxyethylcellulose, cellulose gums and hydroxyalkyl starches. The amount used will vary within the range of from 8% by weight to 40% by weight of the entire composition. Again the amount of binder used will depend upon the final use. Generally the more metal the lower the amount of binder required. Thus higher metal levels, i.e., those above 50% will generally need lower binder levels. The thermosetting binding resin, preferably hydroxypropylcellulose is sized to within the range of particle sizes of 20 U.S. mesh standard sieve screen to 60 U.S. standard mesh screen so a non-segregating blend is achieved when mixed with the metal powder/mineral filler composition.

The final reagent in the composition is a non-corrosive lubricant, with the amount of lubricant being from about 2% by weight of the composition to about 5% by weight of the composition. As those skilled in the art know, lubricants exist in bullet composites in order to minimize barrel damage and to enhance the effect of rifling to increase accuracy. The most preferred lubricants are fatty acid derived lubricants and the most preferred fatty acid is stearic acid. Salts such as calcium stearate also work as does magnesium stearate, sodium stearyl fumarate and other fatty acid lubricants such as triglyceride esters. Even such commercial products as Crisco™ fatty acid triglycerides work.

If desired, a colorant may be added to the composition to allow identification of the source or origin of the bullet or shot. This can be useful for target shooting and for those wanting to know if they for certain hit the animal being hunted.

The totality of the composite formulation is mixed together to provide substantial homogeneity so that each portion of it is generally the same in its amount of each ingredient as any other portion. Mixing can be accomplished in conventional mixing devices that need no description herein.

Once the composite is mixed to provide homogeneity, it can then be formed into bullets or shot using fairly conventional processing of known bullet forming techniques, such as extruding or compressing to form pellets, followed by injection molding to form bullets, sintering, to form bullets, using shot towers to form shot, tablet pressing, etc. The amount of compression, heat, etc. will affect the density which of course affects accuracy, and the manner in which the bullets will handle in ordinary firearms. It is of course desirable to approximate the feel of normal firearms shooting since this is what the user is familiar with. Generally the bullet density should be about 1.75 g/cc to about 8.25 g/cc.

Prior to the processing to make the ultimate bullet or shot, the particulate composition is substantially free flowing since all the particles are reduced to essentially the same granule size and mixed to provide homogeneity.

Published United States Patent Application 2006/0027129 discloses conventional bullet processing. The composites of powdered material may then be spray dried, or may be molded or sintered as they are shown. The description of that published application with respect to spray drying and molding is specifically incorporated by reference herein. Since it is published and known before the filing of this application, it need not be described herein in any detail.

A unique advantage of the bullets of the present invention is they do not ricochet, even with high metal content. This eliminates a substantial danger.

Certain other features are worthy of mention. It is possible for certain uses that the bullets could be copper jacketed. To make the bullet more water resistant they can be coated with a water resistant biodegradable coating. This can be done by spraying, dipping, fluidized bed coating etc.

The present invention is more particularly described in the following examples which illustrate preparation of projectiles for accuracy shooting and measuring of their workability in that environment, and the preparation of projectiles for carrying medicament payloads and testing of their suitability for use in that environment.

It should be understood that these examples are illustrative only and that modifications and variations can be made which will be apparent to those skilled in the art. Again, to emphasize the point, one of the uniquenesses of the present compositions is that they can be tailor made for specific end used. For example as illustrated in the examples below, those with higher metal content are used for increased accuracy which the examples show is achieved. Unless otherwise specified in all examples, the percentage ranges are by weight.

EXAMPLES

In the Examples which follow, the bullets were made by preparing a homogenous mixture of the powder and compression forming it into .40 caliber bullets. Compositions of the powder that was compression formed into the .40 caliber bullets are specified in terms of percent by weight of each ingredient. The weights in grains of the bullets were specified in each example. In the examples below, the compositions were tested for sparking, target penetration, accuracy, ricochet, and finally barrel evaluation. The results are as reported below.

Example 1 (Spark Testing)

In a dark environment bullets of the composition of the present invention were fired through a .40 caliber Glock Model 22 semi-automatic pistol. Compositions were high percent metal containing bullets and were tested at 125 grain weight level and 107 grain weight level. The compositions were 8% hydroxypropylcellulose resin binder, 90% tungsten or ferrotungsten and 2% stearic acid. No sparking was observed. This indicates likelihood of little or no barrel wear caused by repeated firings of the composition through conventional firearms.

Example 2 (Target Penetration)

In this example, tests were made of varying compositions for the bullet and varying weights for the bullet to determine whether the bullets would penetrate smoothly or keyhole which would be a sign of unstable flight and indicate inaccuracy. The first bullet which contained mineral ballast only (no metal) was prepared to contain hydroxypropylcellulose at a 40% level, calcium carbonate at a 55% level, and stearic acid at a 5% level. The bullet weight was 27.5 grains.

A second bullet was prepared to contain no mineral ballast and contained 8% hydroxypropylcellulose, 90% ferrotungsten, and 2% stearic acid, with the bullets having 107 grain weight.

Both the first and second bullets were multiply shot through paper targets at 25 yards through the same Glock Model 22 semi-automatic pistol, with .40 caliber bullets. In addition, they were fired through a Smith & Wesson Model 4006 semi-automatic pistol. For both, the first bullets of mineral ballast only and the second bullets of high metal composition at 25 yards, there were no keyhole hits, indicating stability in flight when fired through conventional firearms.

Example 3 (Accuracy)

The same first and second bullets of Example 2 were fired through a stationary-mounted Glock barrel incorporating a firing pin in a locking breech. They were shot at 25 yards, attempting to put them through a hole down range of 3" diameter. In each case, 20 shots were fired of each bullet type. All of the second type metal ballast bullets went through the 3" hole, i.e., 20 out of 20. None of the mineral ballast (no metal) first bullet went through the hole, indicating as suspected that 100% mineral ballast bullets are unsuitable for anything other than very short range uses.

Example 4 (Ricochet)

This test was to determine whether bullet fragments would ricochet from a stationary metal target. The same first and second bullets of Example 2, .40 caliber, were fired through a Glock Model 22 semi-automatic. For comparison, a third bullet of intermediate formulation between formulations of bullets 1 and 2 was prepared. Formulation 3 comprised .40 caliber 77 grain bullets that were 40% hydroxypropylcellulose, 35% ferrotungsten, 20% calcium carbonate, and 5% stearic acid. 30 bullets of each of the three formulations were tested for ricochet, shooting them at a stationary metal target with ranges varying between 10 and 25 yards. All bullets at all angles from which shots were made, upon hitting the stationary metal, fragmented and turned to powder with no ricochet of fragments at all observable.

Example 5 (Barrel Evaluation)

In this barrel evaluation testing, a Beretta Border Marshal .40 caliber pistol was used. The gun barrel was pre-cleaned and examined. Fifty (50) rounds of mineral ballast (27.5 grain) and high metal composition (107 grain) bullets were fired through the Beretta. The barrel was evaluated using a standard white cloth patch. After pushing the patch through the barrel once, a powder reside covered about 10% of the patch. This residue approximated the samples of patches observed after shooting 50 rounds of conventional standard copper jacketed bullets. Upon even closer visual inspection, no polymer or residue could be detected in the barrel, meaning there was simply no observable difference between firing the bullets of the present invention and standard copper jacketed bullets through the barrel of this Beretta .40 caliber pistol.

From the above examples and discussion, it can be seen the "surprise" of this invention is the ability of the bullet to withstand the heat of firing, i.e. it did not melt or deform significantly upon firing. While not wishing to be bound by a theory, it is believed that the stearic acid lubricant and the polymer melt slightly and uniformly on the surface, thus providing built-in lubricity to the barrel. The polymer likely coats the potentially abrasive metal (tungsten) particles, insulating them from the barrel surface and therefore reduces the likelihood of wear. Evidence supporting this was upon running a "spark test" (bullets fired in the dark); no sparking was observed when tungsten or ferrotungsten were used at high maximum (90% w/w) inclusion.

The above illustrated examples demonstrate the operability of the invention for accomplishing at least all of its stated objectives.

What is claimed is:

1. A non-ricochet ammunition projectile composition comprising:

from about 60% by weight to about 90% by weight of a composite powder combination of metal and mineral filler, said metal being selected from the group consisting of copper, tungsten, steel, bismuth, ferrotungsten, tantalum, zinc, antimony, and mixtures thereof, said mineral filler being a naturally occurring mineral, with the composite powder having a particle size of from 100 U.S. mesh to 325 U.S. mesh;

from about 8% by weight to about 40% by weight of said ammunition composition being a water soluble thermoplastic resin binder; and from about 2% by weight to about 5% by weight of the ammunition composition being a fatty acid lubricant;

said projectile having a density of from about 1.75 g/cc to about 8.25 g/cc and being a non-ricochet projectile when fired.

2. The composition of claim 1 wherein the ammunition has a dosing bullet with the mineral filler being from 40% by weight to 60% by weight.

3. The composition of claim 1 wherein the resin binder is selected from the group consisting of hydroxypropylcellulose, hydroxypropylmethylcellulose, hydroxyethylcellulose, carboxymethylcellulose, methylcellulose, cellulose gums and hydroxylalkyl starches.

4. The composition of claim 1 wherein the fatty acid lubricant is selected from the group consisting of fatty acids, salts of fatty acids, esters of fatty acids and mixtures thereof.

5. The composition of claim 4 wherein the fatty acid is stearic acid.

6. The composition of claim 1 formed in the shape of a bullet.

7. The composition of claim 1 formed in the shape of shot pellets.

8. In a shell for a firearm having a primer, casing and bullet, the improvement comprising:

from about 60% by weight to about 90% by weight of a composite powder combination of metal and mineral filler, said metal being selected from the group consisting of copper, tungsten, steel, bismuth, ferrotungsten, tantalum, zinc, antimony, and mixtures thereof, said mineral filler being a naturally occurring mineral, with the composite powder having a particle size of from 100 U.S. mesh to 325 U.S. mesh;

from about 8% by weight to about 40% by weight of said ammunition composition being a water soluble thermoplastic resin binder; and from about 2% by weight to about 5% by weight of the ammunition composition being a fatty acid lubricant;

said projectile having a density of from about 1.75 g/cc to about 8.25 g/cc and being a non-ricochet projectile when fired.

9. The shell of claim 8 wherein the bullet's resin binder is selected from the group consisting of hydroxypropylcellulose, hydroxypropylmethylcellulose, hydroxyethylcellulose, carboxymethylcellulose, methylcellulose, cellulose gums and hydroxylalkyl starches.

10. The shell of claim 8 wherein the mineral filler is selected from the group consisting of calcium carbonate minerals, silicates, pulverized granite and lava fines.

11. The shell of claim 10 wherein the mineral filler is a calcium carbonate mineral filler selected from the group consisting of aragonite, oyster shells, calcite, chalk, limestone, marble, marl, and travertine.

12. The shell of claim 8 wherein the shell is selected from the group of pistol cartridges, rifle cartridges and shotgun shells.

13. The shell of claim 8 wherein the bullet is a pistol bullet.

14. The shell of claim 8 wherein the bullet is a rifle bullet.

15. The shell of claim 8 wherein the bullet is a shotgun pellet.

* * * * *